United States Patent [19]

Hammer

[11] Patent Number: 4,463,651

[45] Date of Patent: Aug. 7, 1984

[54] PAGE-TURNING DEVICE

[76] Inventor: Mordechai Hammer, Rechov Habonim 32, Kiryat Tivon, Israel

[21] Appl. No.: 389,399

[22] Filed: Jun. 16, 1982

[30] Foreign Application Priority Data

Jun. 23, 1981 [IL] Israel ..... 63154
Mar. 3, 1982 [IL] Israel ..... 65155

[51] Int. Cl.[3] ..... G10G 7/00
[52] U.S. Cl. ..... 84/504
[58] Field of Search ..... 84/502, 503, 504

[56] References Cited

U.S. PATENT DOCUMENTS 1,164,355 12/1915 Johnson et al. ..... 84/504
3,371,571 3/1968 Barbera ..... 84/502

FOREIGN PATENT DOCUMENTS 27929 of 1912 United Kingdom ..... 84/502

*Primary Examiner*—Donald A. Griffin
*Attorney, Agent, or Firm*—Benjamin J. Barish

[57] ABSTRACT

A page-turning device comprises a bi-directional drive and a page-turning unit including an arm of crescent shape having an outer convex surface engageable with the underface of the uppermost page on one side of the book center-line for turning same when the unit is driven in one direction, and an inner concave surface engageable with the uppermost page on the other side of the book center-line for turning the page when the unit is driven in the opposite direction. The unit preferably has two (or more) such arms equally spaced about the circumference of the unit. The illustrated device includes two of such page-turning units, one serving to turn the pages and the other serving to pick them up according to the drive direction. Each unit may include a helical recess for pre-loading the pages, or an arcing finger for arcing each page before being engaged by the respective arm.

10 Claims, 14 Drawing Figures

FIG. 2
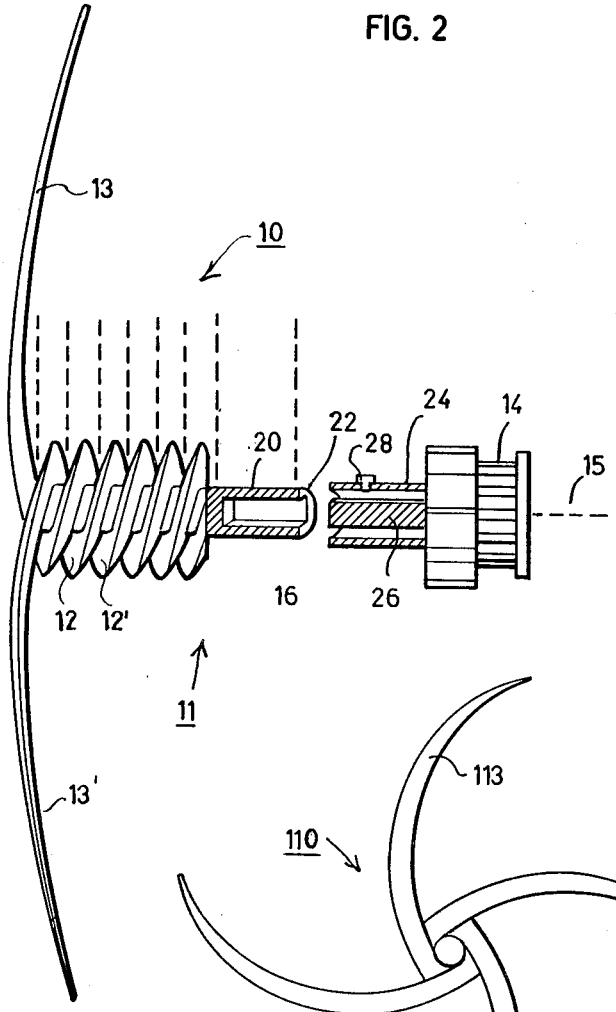
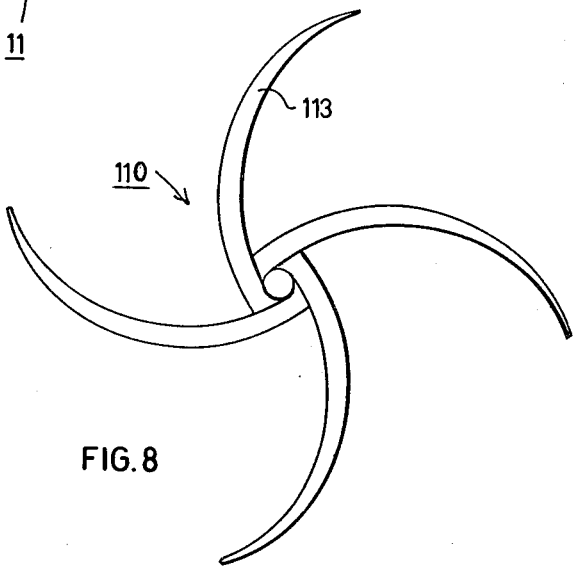
FIG. 8

FIG. 3
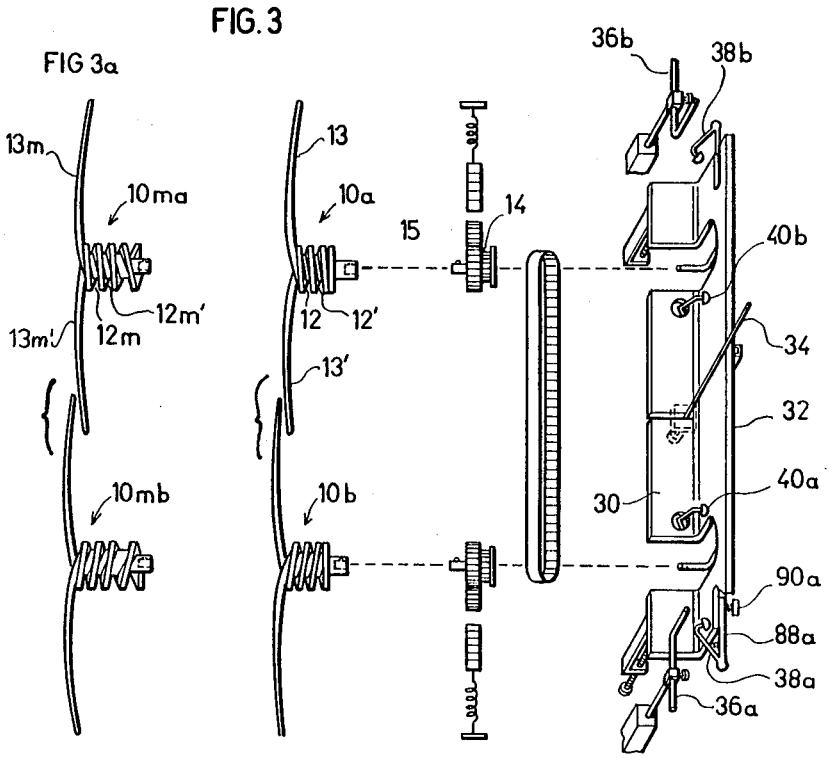
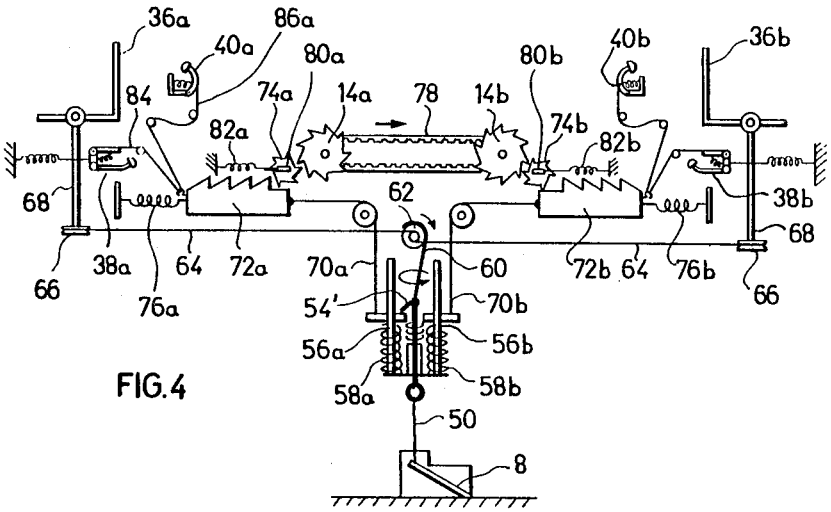
FIG. 4

PAGE-TURNING DEVICE

BACKGROUND OF THE INVENTION

The present invention relates to page-turning devices, such as are used for turning the pages of bound music pads or other bound books.

A number of page-turning devices have been proposed, but insofar as I am aware, none have gained any significant widespread use. An object of the present invention is to provide a new page-turning device having a number of improvements, as will be described more particularly below.

SUMMARY OF THE INVENTION

According to a broad aspect of the present invention, there is provided a page-turning device for turning the pages of a book bound along its center-line, comprising: a holder for the book; a rotatable page-turning unit supported on the holder along one horizontal edge at one side of the book center-line for individually turning the pages; and a drive for rotating the page-turning unit; characterized in that the drive is bi-directional for selectively driving the page-turning unit in either the forward direction or the reverse direction; and in that the page-turning unit includes an arm of crescent shape having an outer convex surface engageable with the underface of the uppermost page on one side of the book center-line for turning same when the page-turning unit is driven by the drive in the forward direction, the crescent-shape arm having an inner concave surface engageable with the underface of the uppermost page on the other side of the book center-line for turning same when the page-turning unit is driven by the drive in the reverse direction.

According to another feature of the present invention, the page-turning unit may include a helical recess terminating at one end in the arm, and at the opposite end in an annular recess such that a number of pages of the book may be pre-loaded in the helical recess and the remaining pages of the book may be retained in the annular recess.

According to another feature, the device may include means for arcing the page to be turned during a page-turning operation, comprising a finger engageable with the outer end of the page to be turned, and means coupling the finger to the drive such that at the beginning of the page-turning operation the finger moves the outer edge of the page inwardly toward the book center-line to cause the page to be arced for receiving thereunder the page-turning arm.

According to a still further feature, the device may include a second rotatable page-turning unit supported on the holder on the opposite side of the book center-line and coupled to the drive, the second page-turning unit being of like construction as the first-mentioned one and oriented such that rotating both units in one direction of the drive causes the first-mentioned unit to turn the pages from one side of the book center-line to the other, while the second unit picks up the pages so turned; and rotating both units in the opposite direction causes the second unit to turn the pages from the opposite side of the book center-line while the first-mentioned unit picks up the pages so turned.

Further features and advantages of the invention will be apparent from the description below.

BRIEF DESCRIPTION OF THE DRAWINGS

The invention is herein described, by way of example only, with reference to the accompanying drawings, wherein:

FIG. 2 is an enlarged exploded view, partly in section, illustrating one of the page-turning units in the device of FIG. 1;

FIG. 3 is an exploded view illustrating the main components in the device of FIG. 1;

FIG. 3*a* is a fragmentary view illustrating two modified page-turning units which may be used in the device of FIGS. 1–3;

FIG. 4 illustrates the drive mechanism for use in the device of FIGS. 1–3;

FIG. 8 illustrates a modified, four-arm page-turning unit that may be used in the described page-turning devices.

DESCRIPTION OF PREFERRED EMBODIMENTS

Figures 1, 7:
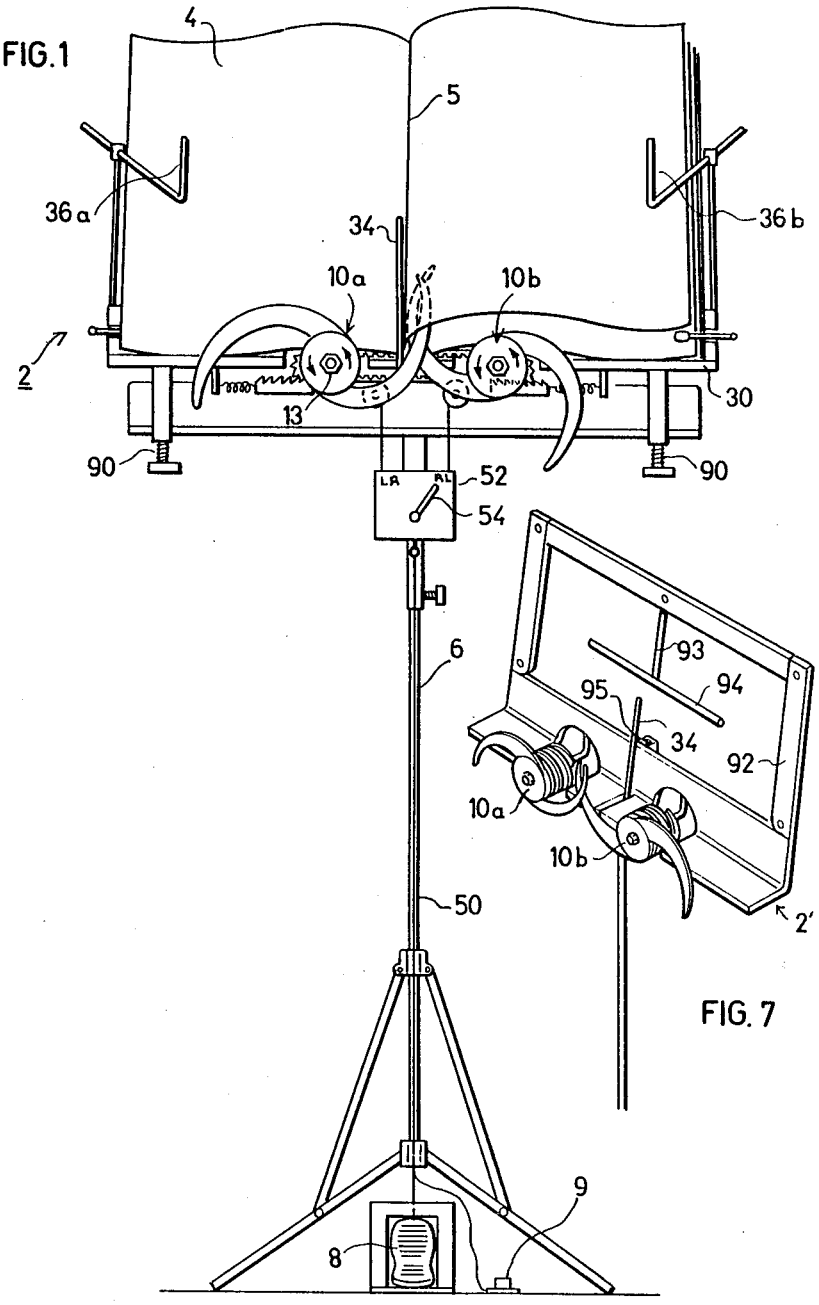
FIG. 1 is a front elevational view illustrating one form of page-turning device constructed in accordance with the present invention.
FIG. 7 illustrates another page-turning device similar to that of FIGS. 1–4 but including a modified holder.

The device illustrated in FIG. 1 comprises a holder, generally designated 2, for holding the book 4 whose pages are to be turned. The device illustrated in FIG. 1 is particularly useful for turning the pages of a music pad, but may be used with respect to other books bound along the book center-line 5, as illustrated. In the example shown in FIG. 1, the page-turning device is supported on a stand 6 and is foot-operated by a foot pedal drive 8; alternatively, it could be operated by an electric motor drive actuated by a foot switch 9.

The illustrated device includes two page-turning units, designated 10*a* and 10*b*, respectively, in FIGS. 1 and 3, supported on the book holder 2 on opposite sides of the book center-line 5. The construction of each of the page-turning units is more particularly illustrated in FIG. 2, and is therein designated 10. It includes a page-loading section 11 formed with two parallel, helical recesses or grooves 12, 12', each terminating in an arm 13, 13' of substantially crescent shape. Each unit 10 further includes a sprocket wheel 14 at its opposite end for rotating the unit about an axis 15. It will be seen that each of the page-turning arms extends in the radial direction from the axis of rotation 15 with its crescent shape providing an outer surface of convex configuration, and an inner surface of concave configuration. As will be explained more particularly below, the convex outer face of each arm engages the pages on one side of the book center-line for turning the pages in one direction, and the concave inner face of each arm engages the pages on the other side of the book center-line for turning the pages in the opposite direction.

At the inner end of the two helical recesses 12, 12' the unit is formed with an annular recess 16 of substantially greater width than the pitch of the helical recesses, for receiving the remaining pages of the book 4 which are not pre-loaded into the helical recesses 12, 12'. Annular recess 16 is of adjustable width, enabling it to be pre-fixed according to the thickness of the book 4, and particularly according to the number of pages of the book which are not pre-loaded in the helical recesses 12, 12'. For this purpose, each unit 10 is made of two parts, namely: one part including the helical recesses 12, 12' and radial arms 13, 13'; and a separable part including the sprocket 14. The first part terminates in a cylindrical pin 20 formed with an axial bore 22, and is telescopically received within the second part in the form of an annular sleeve 24 fixed to the sprocket wheel 14. Sleeve 24 is formed with an axially-extending pin 26 received within bore 22 of pin 20. The two parts are fixed in the desired position by a threaded fastener 28, and are keyed to each other against rotation, e.g. by bore 22 and pin 26 both being of square cross-section.

The holder 2 of the illustrated page-turning device includes a bottom horizontal leg 30 for supporting the book 4, and a backing member 32 (FIG. 3) forming a backing wall for supporting the back of the book. In addition, the holder includes an arm 34 pivotably mounted on the horizontal leg 30 in front of the center of the backing member 32 and engageable with the book 4 along its center-line 5 for clamping the book between it and the backing member. Arm 34 is illustrated in FIG. 3 as being in its closed, vertical position to engage the book along its center-line 5, and thereby to firmly clamp the book between it and backing member 32 of the holder.

FIG. 3*a* illustrates a preferred modification in the construction of the page-turning units, therein designated 10*ma*, 10*mb*. In this modification, the two helical recesses 12*m*, 12*m'* connecting the page-turning arms 13*m*, 13*m'* of each unit to its annular recess (corresponding to 15 in FIGS. 2 and 3) for receiving the non-pre-loaded pages of the book, are open and have a pitch larger than the remainder of the helical recesses. Such an arrangement permits the helical recesses to self-load with one of the non-pre-loaded pages, during each page-turning operation, so that the device can continue to operate even when all the pre-loaded pages have been turned.

The illustrated page-turning device further includes a pair of retainer arms, 36*a*, 36*b*, at the outer ends of the pages on opposite sides of the book center-line. These retainer arms are operated by the drive to retain the book in its open condition.

As indicated earlier, the helical recesses 12, 12' on each of the page-turning units 10 are provided for pre-loading the book pages to be turned. When these helical recesses are omitted, it is desirable to include page-arcing means cooperable with the arms of the page-turning device to arc the pages and thereby to assure that the arms of these units will engage the under face of each page to be turned. The latter page-arcing means comprise a pair of fingers 38*a*, 38*b* engageable with the outer end of each of the two opened pages at a point adjacent to its lower horizontal edge supported on ledge 30, which fingers are movable towards the book center-line, for arcing the respective page; and a further pair of fingers 40*a*, 40*b* each engageable with the opened page at a point thereof between the point of engagement of fingers 38*a*, 38*b* and the book center-line 5, for retaining the page in place during the above-described inner movement of the fingers 38*a*, 38*b* in order to produce an arcing of the page. Fingers 40*a*, 40*b* can be omitted in many cases, as will be described below.

The drive for moving all the foregoing elements is schematically illustrated in FIG. 4, wherein it will be seen that the foot pedal 8 is coupled, by a link 50 extending through the stand 6, to mechanism disposed within a housing 52 at the upper end of the stand 6. The latter mechanism includes a selector knob 54 which may be manually moved to one of two positions in order to preselect the direction of page-turning. Thus, moving knob 54 to the "LR" position illustrated in FIG. 1 effects a turning of the pages in the left-to-right direction, and moving knob 54 to the "RL" position effects a turning of the pages in the right-to-left direction.

As shown particularly in FIG. 4, selector knob 54 includes a coupling element 54' positionable, according to the position of the knob, to couple either a first stem 56*a*, or a second stem 56*b*, to link 50 of the foot pedal drive 8, so that the selected stem is depressed, against the action of its spring 58*a*, 58*b*, by the depression of the foot pedal 8.

Link 50 is also coupled to the two retainer arms 36*a*, 36*b*, so as to open both retainer arms when the foot pedal 8 is depressed at the beginning of a page-turning operation, and to reclose the arms when the pedal is released at the end of a page-turning operation. The coupling between link 50 and the retainer arms 36*a*, 36*b* is schematically shown in FIG. 4 as including a first belt 60 fixed at one end to the upper end of stem 50, and at the opposite end to a drum 62 on which it is windable, and two further belts 64 each fixed at one end to drum 62 and at the opposite end to two pulleys 66 coupled to the two above-mentioned retainer arms 36*a*, 36*b*, the latter being spring-urged to arm-closed positions illustrated in FIG. 4.

The two depressable stems 56*a*, 56*b* are each coupled to the sprocket 14*a*, 14*b* of its respective page-turning unit 10*a*, 10*b*, via a mechanism, schematically illustrated in FIG. 4, as including a pulley belt 70*a*, 70*b*, fixed at one end to the respective stem 56*a*, 56*b*; a rack 72*a*, 72*b* fixed to the opposite end of the pulley; and an intermediate gear 74*a*, 74*b* interposed between each rack 72*a*, 72*b* and its sprocket wheel 14*a*, 14*b*. The two racks 72*a*, 72*b* are normally retained in their illustrated outermost positions by springs 76*a*, 76*b*; but each rack, as selected by selector knob 54, is movable inwardly towards the book center-line 5 upon depression of the foot pedal 8 to rotate its respective sprocket wheel 14*a*, 14*b*. Both sprocket wheels are coupled together by a belt 78 so that the rotation of one will also effect the rotation of the other in the same direction; but the direction in which both are rotated by the depression of the foot pedal 8 depends on the position of the direction selector knob 54.

The intermediate gears 74*a*, 74*b* coupling the racks 72*a*, 72*b* to their respective page-turning units 10*a*, 10*b* are each rotatably mounted within an elongated slot 80*a*, 80*b*, and are each normally urged, by a spring 82*a*, 82*b*, out of engagement with their respective sprocket wheels. However, when one of the racks (e.g., 72*a*) is moved inwardly by the depression of foot pedal 8, the rack also moves its gear (e.g., 74*a*) towards its respective sprocket wheel (e.g., 14*a*), whereby the gear becomes effective to couple the moved rack to the sprocket wheel; but as soon as the rack has completed its inward (driving) stroke and starts to return (outwardly) to its normal position, its gear moves away from the sprocket wheel, thereby decoupling the latter from the rack during this return stroke. Accordingly, during each operation of the device, only one rack (72*a* or 72*b*) will be positively driven by the foot pedal drive 8, but both of the sprockets 14*a*, 14*b* will be driven so that the arms of the two units driven by the sprocket wheels 14*a*, 14*b* will also be driven, the direction depending upon the selector knob 54.

The two fingers 38*a*, 40*a* are coupled to their respective rack 72*a* such that when the rack is actuated, the two fingers are moved in synchronism to produce an arc in the page to be turned, in order to facilitate the entry of the respective page-turning arm (e.g. 13*ma* of FIG. 3*a*) under the page to be turned at the beginning of the page-turning operation. Both fingers 38*a* and 40*a* are coupled to their respective rack 72*a* by a coupling schematically indicated at 84*a* and 86*a*.

In order to permit the arc-producing fingers 38*a* to accommodate different sized books, it preferably is mounted on an arm 88*a* (see FIG. 3) which is adjustable by loosening a threaded fastener 90*a*, to permit it to be preset with respect to the book center-line 5 according to the size of the book to be clamped to the holder.

A similar arrangement producing a similar operation is provided with respect to fingers 38*b* and 40*b* coupled to rack 72*b* so as to produce an arc in the opposite page upon the depression of foot pedal 8 when the direction selector 54 is set to effect a right-to-left turning of the pages. Preferably, the fingers 38*a*, 38*b*, as well as 40*a*, 40*b*, are made of transparent plastic.

Figure 5A:
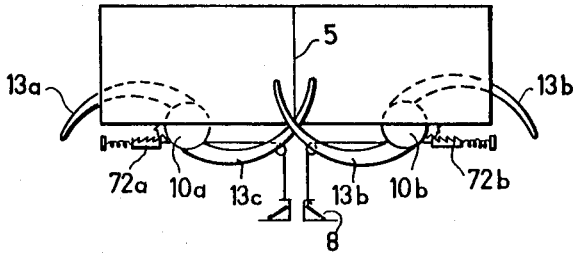
FIGS. 5*a*–5*c* illustrate the operation of the page-turning unit in the devices of FIGS. 1–4, FIG. 5*b* illustrating a right-to-left page-turning operation and FIG. 5*c* illustrating a left-to-right page-turning operation.
Figure 5B:
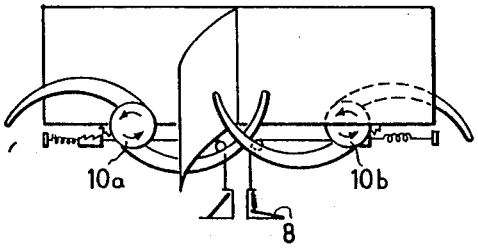

The operation of the device of FIGS. 1–4 will be understood by reference to the diagrams of FIGS. 5*a*–5*c* and 6*a*–6*d*. FIG. 5*b* illustrates the operation of the page-turning unit 10*b* to effect a right-to-left turning of the pages, and the diagrams of FIGS. 6*a*–6*d* illustrate the movement of the fingers 38*b* and 40*b* during this operation; this operation is produced when the direction selector 54 is set to the "RL" (FIG. 1) position and the foot pedal 8 is depressed. In the normal condition of the illustrated device, the two retainer arms 36*a*, 36*b*, and the page-arcing fingers 38*a*, 38*b* and 40*a*, 40*b* are all in their closed positions spring-pressed against the open pages of the book.

Figure 6A:
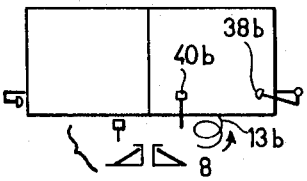
FIGS. 6*a*–6*d* illustrate the operation of the page-arcing means in the devices of FIGS. 1–4 for arcing a page during a page-turning operation.
Figure 6B:
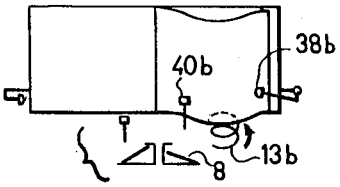
Figure 6C:
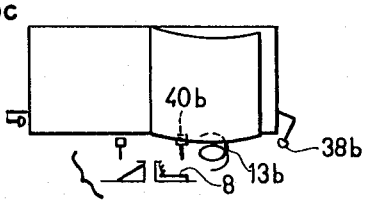
Figure 6D:
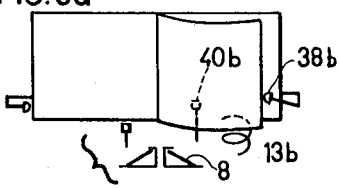

At the beginning of the depression of the foot pedal with selector 54 in the "RL" position, rack 72*b* (FIG. 4) begins to move inwardly towards its sprocket wheel 14*b*. At the beginning of this movement, its finger 38*b* (FIG. 6*a*) begins to move inwardly towards the book center-line. This causes the page to arc, as shown in FIG. 6*b*, permitting the page-turning arm 13*b* to enter the space between the upper arced page and the underlying page. As soon as the arm has entered this space, both fingers 40*b* and 38*b* disengage from the page (FIG. 6*c*), permitting the arm to start to turn the page toward the book center-line. At this time, inner finger 40*b* returns to engage the underlying page (FIG. 6*d*), while arm 13*b* of unit 10*b* comes into position behind the page being turned and begins to turn the page toward the book center-line 5. As the page approaches the center-line, an arm 13 of the other unit 10*a* comes behind the page, picks it up, and completes the turning movement. At the end of the page-turning operation, the page-arcing fingers 38*a*, 38*b*, 40*a*, 40*b* return into engagement with the open page.

The retaining arms 36*a*, 36*b* move out of engagement with the book pages at the beginning of the page-turning operation, and return into engagement with them at the end of the page-turning operation.

It will be appreciated that the convex outer surface of arm 13*b* of unit 10*b* engages the underface of the page being turned and starts the turning of the page, while the concave inner face of arm 13*a* of unit 10*a* picks up the page as it approaches the book center-line 5 and completes the page-turning operation, as shown in FIG. 5*b*.

Figure 5C:
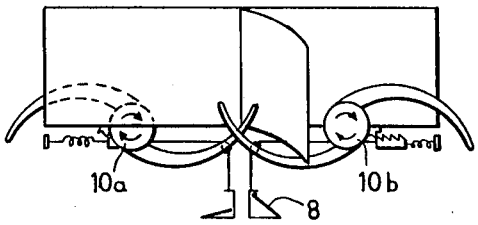

When the direction selector 54 is set to the "LR" (FIG. 1) position, the same operation occurs, except that the left unit 10*a* starts the page-turning operation, and the right unit 10*b* completes it, as schematically indicated in FIG. 5*c*. It will be appreciated that both units 10*a*, 10*b* may therefore be used for turning the pages in either direction, the direction being selected by the selector 54.

However, the bi-directional turning of the pages can also be effected by the use of only one unit, 10*a* or 10*b*, together with the page-arcing fingers 38*a* or 38*b*. Thus, if, e.g., only unit 10*b* is provided, the page-arcing finger 38*b* can be actuated as described above, i.e. counter-clockwise, in order to arc each page on that part (right part in FIGS. 5*a*–5*c* and FIGS. 6*a*–6*d*) of the book center-line 5 in order to enable the outer convex surface of the respective arm 13*b* to engage the page and to turn it, the arm in this case being extended so as to project substantially past the book center-line and thereby to complete the page-turning operation itself. On the other hand, if the pages are to be turned in the opposite direction, unit 10*b* would be rotated in the opposite direction (i.e., clockwise) and would cooperate with the page-arcing finger 38*a* on the opposite side (left) of the book center-line, the latter arcing the page at the beginning of the page-turning operation to assure that the concave inner face of the arm engages the page to be turned and turns it during the continued rotation of the unit 10*b*.

It will also be appreciated that in either case, fingers 40*a*, 40*b* may be omitted, in which case the arcing of the respective page would between the respective fingers 38*a*, 38*b* and the book center-line 5.

The device illustrated in FIGS. 1–4 is particularly useful for clamping to an existing stand 6, or to another support, this being effected by the use of a pair of clamping fasteners 90. The device, however, can be built into a stand, this being shown at 2' in FIG. 7. Particularly when built into a stand, it may be desirable, as shown, to provide the backing wall in the form of an open frame 92, which frame includes a center vertical bar 93 terminating in a horizontal bar 94, such that the book is firmly held in position between a front clamping bar 34' (corresponding to bar 34 in FIG. 1) and the horizontal back bar 94. The stand 2' illustrated in FIG. 7 is of the collapsible type, and is attachable to the vertical standard by a clamping bar 95.

The drawings illustrate each of the two page-turning units as including two radial arms of crescent shape located at opposite sides of the units, so that each unit need be rotated only one-half revolution to effect a complete page-turning operation. However, each unit may include only one such page-turning arm, in which case it would require a complete 360° rotation for a page-turning operation; or it could include a larger number of arms to correspondingly decrease the rotation needed in order to effect a turning of a page. FIG. 8 illustrates such a unit, generally designated 110, as including four such radiating arms 113, equally spaced about the circumference of the rotational axis of the unit. It will be appreciated that a four-arm unit as illustrated in FIG. 8 will require but a one-fourth revolution to turn a page.

It will also be appreciated that any or all of the page-arcing fingers 38*a*, 38*b*, 40*a*, 40*b* may be omitted, or may be provided and selectively decoupled by disconnecting them from the drive (e.g., from their racks 72*a*, 72*b*), according to the particular application of the device.

Many other variations, modifications and applications of the invention will be apparent.

What is claimed is:

1. A page-turning device for turning the pages of a book bound along its center-line, comprising: a holder for the book; a rotatable page-turning unit supported on said holder along one horizontal edge at one side of said book center-line for individually turning the pages; and a drive for rotating said page-turning unit; characterized in that said drive is bi-directional for selectively driving said page-turning unit in either the forward direction or the reverse direction; and in that said page-turning unit includes an arm of crescent shape having an outer convex surface engageable with the underface of the uppermost page on one side of the book center-line for turning same when the page-turning unit is driven by said drive in the forward direction, said crescent-shape arm having an inner concave surface engageable with the underface of the uppermost page on the other side of the book center-line for turning same when the page-turning unit is driven by said drive in the reverse direction.

2. The device according to claim 1, wherein said holder includes a backing member for supporting the back of the book, and a vertical arm pivotably mounted in front of the center-line of said backing member and engageable with the book along its center-line for clamping the book between it and the backing member.

3. The device according to claim 1, further including a pair of retainer arms on opposite sides of the book center-line for engaging the outer ends of the pages; and means for coupling said retainer arm to said drive to move them to an open position disengaged from the book pages at the beginning of a page-turning operation, and to move them to a closed position engaging the book pages at the end of a page-turning operation.

4. The device according to claim 1, wherein said page-turning unit includes a helical recess terminating at one end in said arm, and at the opposite end in an annular recess such that a number of pages of the book may be pre-loaded in said helical recess and the remaining pages of the book may be retained in said annular recess.

5. The device according to claim 4, wherein the end of said helical recess bounding said annular recess is open and has a pitch larger than the remainder of the helical recess for self-loading the latter recess with pages from the non-preloaded pages of the book during the operation of the device.

6. The device according to claim 1, further including means for arcing the page to be turned during a page-turning operation, comprising a finger engageable with the outer end of the page to be turned, and means coupling said finger to said drive such that at the beginning of the page-turning operation said finger moves the outer edge of the page inwardly toward the book center-line to cause the page to be arced for receiving thereunder the page-turning arm.

7. The device according to claim 1, wherein said page-turning unit includes at least two page-turning arms extending in the radial direction from the axis of rotation of said page-turning unit and equally spaced about the circumference thereof.

8. The device according to claim 1, further including a second rotatable page-turning unit supported on said holder on the opposite side of the book center-line and coupled to said drive, said second page-turning unit being of like construction as the first-mentioned one and oriented such that rotating both units in one direction of said drive causes the first-mentioned unit to turn the pages from one side of the book center-line to the other, while the second unit picks up the pages so turned; and rotating both units in the opposite direction causes said second unit to turn the pages from the opposite side of said book center-line while the first-mentioned unit picks up the pages so turned.

9. The device according to claim 8, further including: a rack for each of said page-turning units; means for selectively coupling said rack to the drive for selectively moving one rack in one direction, or the other rack in the opposite direction, according to the direction of operation of the drive; a sprocket for each of said page-turning units; means for coupling each of said sprockets to one of said racks so as to be driven thereby when the rack is driven by the drive; and means for coupling one sprocket to the other sprocket such that the rotation of one by its respective rack also rotates the other.

10. The device according to claim 1, wherein said drive is foot-operated and includes a presettable selector for preselecting the direction of rotation of the page-turning during a page-turning operation.

* * * * *